United States Patent [19]

Fischer

[11] 4,220,083

[45] Sep. 2, 1980

[54] BEARER RING-PRESS CYLINDER CONNECTION CONSTRUCTION FOR ROTARY PRINTING MACHINE

[75] Inventor: Hermann Fischer, Augsburg, Fed. Rep. of Germany

[73] Assignee: M.A.N.-Maschinenfabrik Augsburg-Nurnberg Aktiengesellschaft, Augsburg, Fed. Rep. of Germany

[21] Appl. No.: 962,394

[22] Filed: Nov. 20, 1978

[30] Foreign Application Priority Data

Nov. 30, 1977 [DE] Fed. Rep. of Germany ..... 2753296

[51] Int. Cl.[3] ..... B41F 5/00

[52] U.S. Cl. ..... 101/216; 308/62

[58] Field of Search ..... 101/212, 216, 217; 308/40, 41, 56, 62, 237 R, 237 A, 239, 37, DIG. 11, 20, 53, 57; 129/148.1

[56] References Cited

U.S. PATENT DOCUMENTS

| | | | |
|---|---|---|---|
| 2,107,214 | 2/1938 | Rechtin et al. | 308/62 |
| 2,180,046 | 11/1939 | Gleissner | 308/62 |
| 2,598,726 | 6/1952 | Stempel | 101/217 |
| 2,762,295 | 9/1956 | Varga et al. | 101/216 |
| 3,303,557 | 2/1967 | Litsky | 308/239 X |
| 3,329,472 | 7/1967 | Donnellan et al. | 308/237 |
| 3,729,238 | 4/1973 | Arnold | 308/62 |
| 4,095,856 | 6/1978 | Markovitz | 308/62 X |
| 4,111,499 | 9/1978 | McCloskey | 308/237 R X |
| 4,133,586 | 1/1979 | Maurer | 308/237 R |
| 4,162,812 | 7/1979 | Takata et al. | 308/237 R X |

FOREIGN PATENT DOCUMENTS

| | | | |
|---|---|---|---|
| 1525178 | 11/1969 | Fed. Rep. of Germany | 308/62 |
| 717486 | 10/1954 | United Kingdom | 101/216 |
| 991792 | 5/1965 | United Kingdom | 101/216 |

OTHER PUBLICATIONS

"Printing Machinery News" published by Maschinenfabrik Augsburg Works, #63, 5/77.

*Primary Examiner*—E. H. Eickholt

*Attorney, Agent, or Firm*—Frishauf, Holtz, Goodman & Woodward

[57] ABSTRACT

To provide for engagement between adjacent bearer rings throughout their entire engagement line or surface, in spite of slight misalignment or tilting of the actual axis of rotation of the shaft of the printing cylinder with which the bearer ring is associated, the bearer ring is located on the shaft of the printing cylinder with a slightly spherical engagement surface, preferably by attaching a hub to the shaft having a slightly convex outer surface which matches a slightly concave inner surface of the bearer ring. Preferably, a shock-absorbing, wear-resistant elastic material is interposed between the respective engagement surfaces. To permit alignment of the bearer ring with respect to the cylinder, and exact concentricity, eccentric alignment pins are provided, engaging the bearer ring and the end face of the printing cylinder, at least three such attachment arrangements being located circumferentially on the end face of the printing cylinder, and bearer ring, respectively.

10 Claims, 2 Drawing Figures

BEARER RING-PRESS CYLINDER CONNECTION CONSTRUCTION FOR ROTARY PRINTING MACHINE

Figure 1:
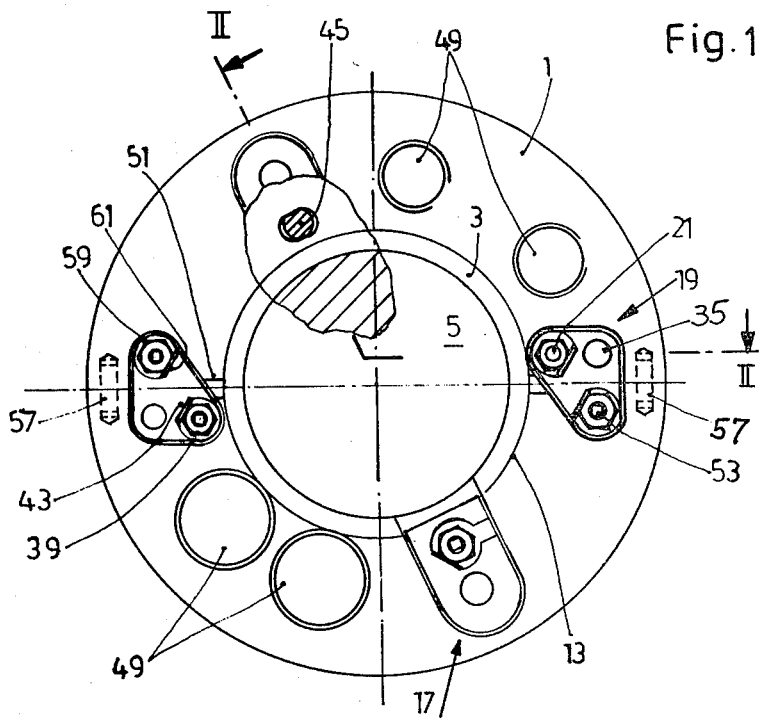

The present invention relates to rotary printing presses, and more particularly to the connection construction to connect bearer rings or cylinders bearers with associated respective printing press cylinders.

BACKGROUND AND PRIOR ART

Printing press cylinders require maintenance of accurate distances between the respective cylinders of the printing press. In order to provide such accurate spacing in operation of the machine, the printing press cylinders are provided with bearer rings or cylinder bearers at the end facing surfaces thereof which run off or roll off one against the other. The bearer rings are engaged with each other by applying forces to the shafts on which they operate to control the engagement of one bearer ring connected to one cylinder with the bearer ring of an adjacent cylinder, the two bearer rings being in rolling engagement.

In one such construction, the bearer rings are formed with a central bore and are seated on the shaft of the associated cylinder. Such a connection has been previously described, see, for example, "Druckmaschinen-Nachrichten" No. 63, pages 3 to 23 ("Printing Machinery News"). Heavy printing cylinders cause bending of the respective shafts, that is, a deviation of the shaft from a true straight-line theoretical axis of rotation. Consequently, the bearer rings which roll off against each other are no longer in rolling engagement throughout their entire width. Only a narrow edge portion of the respective bearer rings may remain in engagement with each other. Changing the actual width of engagement of the bearer rings changes the loading forces and substantially increases the engagement forces between the bearer rings per unit area beyond those forces which were calculated based on the entire width of the bearer rings themselves. The increased loading on the engagement surface of the bearer ring may be so great that the permitted loading on the bearer rings is greatly exceeded. It has been noted that the bearer rings are damaged in operation.

THE INVENTION

The engagement characteristics of associated bearer rings were investigated to analyze the cause for damage to the bearer rings and, after discovery of the non-uniform engagement of respective bearer rings against each other, it became an object to so construct the bearer ring-printing cylinder connecting construction that damage to the running surfaces of the bearer rings due to excessive loading force could be greatly decreased.

Briefly, the engagement surfaces of the shaft with the bearer ring are axially bowed, for example are made to be slightly spherical, for example by shaping the shaft of the printing cylinder slightly convex, and the engaging surface of the central bore of the bearer ring in matching form slightly concave. This arrangement permits a slight self-adjusting floating connection between the shaft and the bearer ring itself so that the alignment between adjacent bearer rings for parallel surface engagement can be maintained. The bearer ring, thus, can tilt slightly with respect to the actual shaft axis to maintain alignment with an adjacent bearer ring.

A spherical connection or part-spherical connection, as such, between a fixed bearing portion and a rotating shaft are well known in order to provide for self-alignment of a shaft in a bearing. In heavy machinery, and more particularly in printing machines in which the bearer rings are located against and secured to the end faces of printing cylinders, and where accuracy of spacing between adjacent cylinders as determined by the position of the bearer rings is important, it was heretofore customary to use a rigid connection between the bearer rings and the associated printing cylinder itself, in spite of the possible damage to the bearer rings. Accuracy of spacing and alignment of the printing cylinders can be maintained, however, also with a self-aligning or slightly floating connection between the bearer ring and the associated cylinder of the printing press.

Not every one of the bearer rings has to be constructed in this way; the arrangement has the advantage that at least one of two bearer rings which are in rolling engagement can change their position slightly with respect to the actual shaft axis so that the width of engagement, that is, the engagement line or engagement area of the bearer rings can be increased to the design value, that is, to the entire width of the bearer ring. The loading on the bearer ring, then, will be essentially uniform.

The connection between the shaft of the cylinder of the printing press and the bearer ring is preferably effected by an intermediate hub portion which is fitted with a cylindrical bore on the shaft of the associated cylinder. The hub itself has a slightly spherical outer circumference on which the bearer ring is mounted. This arrangement facilitates assembly.

The bearer rings can be subjected to substantial shocks and may even lose contact with each other. This may occur if, for example, the rubber blanket of a printing cylinder is a little too thick; if paper dust or lint collects thereon, or if a bulge appears close to the clamping grooves of the cylinders of the printing system, resulting in impingement of two adjacent bearer rings as the clamping grooves run off against each other. These shock forces can be large and, after some operating time, lead to damage of the bearer rings. In accordance with an embodiment of the invention, the shock forces can be elastically accepted by interposing an elastic, shock-absorbing material between the engagement surface transferring forces to the shaft of the printing cylinder and the bearer ring itself, for example at the engagement surface in the central bore of the bearer ring. The material preferably should be tough and resistant against wear.

The intermediate elastic layer has the additional advantage that it also prevents damage to the bearer rings due to corrosion and wear at the surface between the bearer ring and the shaft. The intermediate layer is preferably so applied that it separates the central bore of the bearer ring from the associated shaft portion, thus effectively isolating the shaft and the bearer ring from each other. Such corrosion may be due to a too tight fit, wear due to friction upon tilting movement about the self-aligning surface, or the like. It is usually difficult to introduce lubricant between the bearer ring and the shaft; damage to this slight microscopic movement is thus effectively prevented.

Introducing an elastic insert has substantial advantages; yet, the elastic insert itself may cause difficulty. It must be accurately fitted between the bearer ring and the shaft. If the manufacture of the elastic insert is not accurate, or if the elastic insert is cast into the gap between the shaft and the bearer ring, and the shaft and bearer ring are not exactly concentric, deviations from true running of the bearer ring with respect to the shaft may result, causing additional unbalance force and particularly pounding forces. In accordance with a feature of the invention, such unbalance forces, or out-of-concentricity conditions, can be eliminated by securing the bearer ring to the respective associated cylinder by three connections from the bearer ring to the end face of the cylinder. These connections are formed as bores through the bearer ring, so positioned that they are not on a single straight line, and matching similar bores in the end face of the printing cylinder. The bores then have pins introduced therein which have parts eccentric in the portion located in the cylinder with respect to the portion located in the bearer ring. By rotation of these pins, the radial and circumferential alignment of the bearer ring with respect to the associated cylinder can be readily obtained. The pins are locked in position, for example, by a locking pin which is fitted in a holding plate secured to the end face of the bearer ring.

Bearer rings require replacement; to permit replacement from time to time, it is customary to subdivide the bearer ring into portions permitting radial separation. Usually, a radial gap is provided, extending diametrically across the bearer ring to permit splitting the bearer ring and removal of the two halves without removing the associated printing cylinder, and its shaft, from the machine. The connection element for the two bearer ring halves can be combined with the holding element for the eccenter pin used for alignment of the bearer ring with the associated cylinder. For example, an additional opening can be formed in the holding plate and so positioned that the additional opening and the locking pin opening fit into different halves of the bearer ring to form a connection therefor, thus providing for multiple use of the same element.

Assembly of the eccentric adjustment pins connecting the bearer pin to the end face of the associated cylinder is simplified and facilitated by forming the portion of the alignment pin which fits into the end face of the cylinder with a somewhat spherical circumference; additionally, an underlay or washer of elastic impact-absorbing, shock-absorbing and wear resistant material is preferably interposed between the bearer ring and the end surface of the associated printing cylinder.

Damage to the bearer rings can occasionally be observed already quite some time before it becomes noticeable and interferes with proper printing. Such damage is observable by microscropic markings and uneven surface conditions at the roll-off surfaces of the bearer rings. Additionally, vibration and pounding of the machine may be noticed. The bearer rings can still be used, however, particularly if they are adjustable tangentially. By changing the relative engagement zones between adjacent bearer rings, a self-healing or self-curing effect is obtained, and the life of the bearer rings is substantially extended. The position of the bearer ring with respect to the associated cylinder must be so changed that damaged surface areas no longer meet the same surface areas of the next adjacent bearer ring with which it is in engagement. Tangential adjustment of the bearer ring is facilitated, in accordance with a feature of the invention, by forming one of the bores accepting the eccentric adjustment pins—preferably the bore in the end face of the printing cylinder—as a part-circular elongated opening, to permit tangential or circumferential adjustment of the relative position of a bearer ring with respect to its associated cylinder.

Figure 2:
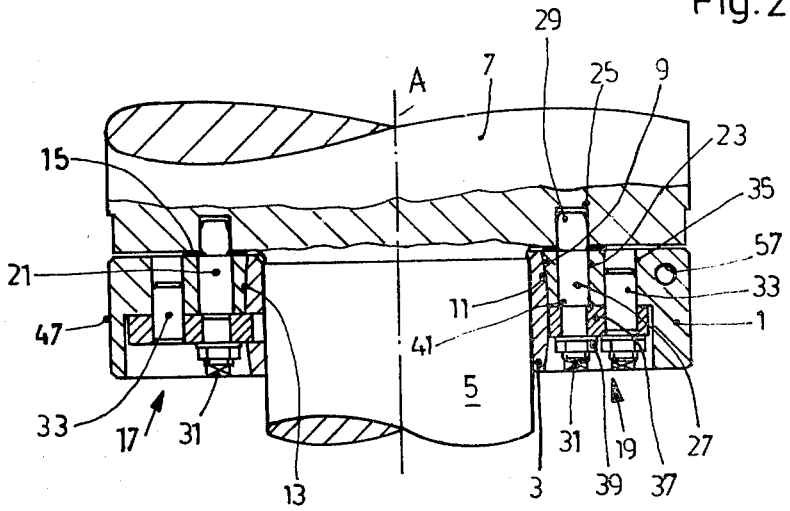

Drawings, illustrating a preferred example, wherein:

FIG. 1 is a schematic and elevational view of a bearer ring, partly broken away; and FIG. 2 is a cross-sectional view along the section line II—II of FIG. 1.

A bearer ring 1 has a central opening or bore fitted on a hub 3. The hub 3 has a cylindrical bore which fits on a shaft 5 of an associated printing cylinder 7. The hub 3 has an outer surface 9 which is at least slightly spherical (see FIG. 2). The inner surface 11 of the bearer ring 1 is slightly concave, matching the convex outer surface 9 of the hub 3. The surface 11 thus permits slight tilting of the bearer ring 1 about an axis A (FIG. 2), which extends through a plane located perpendicular to the plane of FIG. 2. The shaft axis, which can deflect due to the weight and pressure applied to the printing cylinder 7, thus will not force the associated bearer rings to a similar deflection; rather, the bearer ring can adjust itself for full surface contact of its running surface with the bearer ring of an adjacent printing cylinder.

An intermediate layer 13 of wear-resistant, elastic, impact or shock-absorbing material is located between the outer surface 9 of the hub 3 and the inner surface 11 of the bearer ring. This material, for example, may be a foil of Teflon, for example, PTFE, or it may be an PIV foil; it may also consist of compacted cardboard. The intermediate layer 13 has the function of elastically absorbing pounding forces acting on the bearer ring, to distribute the forces around the circumference and to compensate forces and, additionally, to separate the bearer ring from the shaft, or the hub thereof, in order to prevent the formation of corrosion between the surfaces 9 and 11, which should retain their part-spherical configuration and permit slight movement of the bearer ring with respect to the shaft axis A.

A shock-absorbent, wear-resistant, and elastic washer or disk or separating layer 15 is preferably interposed between the end face of the cylinder 7 and the fitting end face of the bearer ring 1. Suitably, the washer or disk 15 is made of the same material as that of the intermediate layer 13, permitting slight tilting of the bearer ring 1 with respect to the end face of the printing cylinder and additionally facilitating matching of the running or roll-off surfaces of two adjacent bearer rings and floating adjustment of the axis of rotation of the bearer ring with respect to the actual axis A of the shaft.

The bearer ring 1 may operate slightly out-of-round. It is particularly difficult to make an elastic intermediate layer 13 so that it exactly fits on the outer surface 9. While it is possible to make accurate components of this type, the cost of doing so may be excessive. In some constructions, the material of the elastic layer 19 can be applied in liquid form and cast in the gap between the outer surface 9 and the inner surface 11 of the hub, and bearer ring, respectively. Unless extreme accuracy is maintained, the bearer ring may be slightly out-of-round, or not exactly concentric with respect to the associated printing cylinder. It is thus desirable to so mount the bearer ring on the end face of the printing cylinder 7 that it can be accurately centered with respect thereto. To provide for such adjustable attachment, two or three-part locking arrangements 17, 19 are provided, each having eccentric pins 21 fitting into a first bore 23 in the bearer ring 1 and, additionally, into a second bore 25 formed in the end face of the associated printing cylinder 7. The portion 27 of the shaft of the pin 21 is eccentric with respect to a second portion 29 of the shaft, the portion 29 fitting into the bore 25 of the printing cylinder 7, and the portion 27 fitting into the bore 23 of the bearer ring. Rotation of the pin 21, for example by a wrench applied to a squared-off end portion 31 permits slight change of the relative position of the bearer ring 1 with respect to the printing cylinder 7 and thus circumferential, and hence concentric alignment of the bearer ring and the printing cylinder. Adjustment, essentially, is in radial direction. Suitable orientation of the two shaft portions 27, 29 of the respective pins then provides for accurate concentric alignment of the bearer ring and the associated cylinder.

The bearer ring 1 is maintained plane with respect to the end face of the associated printing cylinder upon rotation of the pins 21 by a guide pin 33 located immediately adjacent to the pin 21 in the respective lock elements 17, 19. The guide pin 33 prevents spurious or undesired tilting of the bearer ring with respect to the cylinder 7, and forcing of the bearer ring into an undesired position. The guide pin 33 is connected with the eccenter pin 21 by a link plate 37, in which the guide pin 33 is fitted. The eccenter pin 21 is rotatably positioned in the link plate 37. Preferably, the first shaft portion 27 of the eccenter pin 21 is concentric with respect to the pin body fitting through the link plate 37, the second shaft portion 29 being eccentric with respect thereto.

A nut 39 is threaded on the eccenter pin 21 to ensure aligned position of the eccenter pin and prevent spurious rotation. The nut 39, upon being tightened, will pull a flange or an offset 41 of the pin 21 against the plate 37. A holding washer 43, with a bent-up portion can be placed against one of the surfaces of the nut 39 to prevent its rotation, once tightened.

The portion of the shaft 29 fitted into the bore 25 in the end face of the cylinder 7 preferably is made at least part-spherical in order to permit tilting adjustment of the bearer ring 1, with respect to the end face of the cylinder 7.

The bore formed in the printing cylinder which receives the portion 29 of the pin 21 is preferably formed as an elongated hole, extending circumferentially, as shown at 45 in FIG. 1; a similar showing has been omitted from the remaining portions of the drawings for clarity. This permits circumferential adjustment of the bearer ring 1 after some operating time if wear is apparent at the running surface 47 thereof. Such circumferential or tangential adjustment permits change of the relative position of the bearer ring with respect to an adjacent bearer ring so that circumferential areas which are undamaged will be contacted by areas of an adjacent bearer ring which might have caused the damage.

Radial correction for lack of eccentricity of the bearer ring 1, the intermediate layer 13, and the associated printing cylinder 7 can be effected by three two-element connections 17 having, respectively, three eccentric pins 21, provided the three connections are not on a single straight line, that is, act in different effective vectorial directions. The adjustment is simplified, however, if bores 49 which may already be present in the end face of the bearer ring 1 can be utilized if more than three such locking elements are used, for example four locks 17, 19.

Many bearer rings are made in two segments, separated by a radial, diametrically extending cut 51. The bearer ring, then, will actually consist of two half-ring portions. This permits repair of the bearer ring without disassembly of the associated printing cylnder 7, or the shaft thereof, from the machine. By suitable selection of the lock elements in two or three-position form, it is possible to utilize the lock elements not only for radial correction, but additionally for tangential connection of the two bearer ring halves and relative adjustment thereof. Locks 19, located at diametrically opposite positions with respect to the axis A of the shaft 5, will be provided with two eccenter pins, that is, with an eccenter pin 21 and an additional eccenter pin 53, which may be identical to that of pin 21, and engaging a fourth and similarly formed bore in the bearer ring 1, likewise rotatably positioned against the holding plate 37. The two bearer ring halves are connected by bolts 57. In assembly, they are first preliminarily and roughly connected by the bolts 57 and then tightly connected together by rotation of the second eccenter pin 53. This connection, then, is not influenced at a later time by rotation of the adjacent eccenter pin 21 which provides for adjustment for concentricity. The eccenter pin 53 is preferably secured by a nut 59 and a bent-over washer 61, similarly to the attachment of the eccenter pin 21. The lock elements 17 used only for adjustment of concentricity require only two bores in the plates 37; the lock elements 19 which are additionally used to connect the bearer ring halves together are formed with three openings.

Various changes and modifications may be made within the scope of the inventive concept.

I claim:

1. In a rotary printing press, a bearer ring (1) - press cylinder (7) connection construction, in which the bearer ring (1) is mounted on the shaft (5) of the cylinder for rotation therewith and positioned against an end face of the cylinder, the shaft passing through the bearer ring, and wherein, in accordance with the invention, the engagement surfaces (9, 11) of the shaft and of the bearer ring are axially bowed or rounded to form, respectively, matching concave-convex engagement surfaces to permit slight floating alignment of the bearer ring with respect to the axis of rotation of the respective printing cylinder and tilting of the plane of rotation of the bearer ring with respect to the direction of the axis of rotation of the shaft in the region of said engagement surfaces.

2. Construction according to claim 1, further comprising a hub element (9) secured to the shaft (5) of the press cylinder (7), the hub element having a part-spherical outer surface and forming the shaft engagement surface (9), the hub element (3) having a cylindrical bore fitting on the shaft (5) of the cylinder (7).

3. Construction according to claim 1, further comprising an intermediate layer (13) made of an elastic, shock-absorbing, wear-resistant material located between the engagement surfaces (9, 11) of the bearer ring (1) and of the shaft, respectively.

4. Construction according to claim 1, further including a washer or disk-shaped element (15) of elastic, shock-absorbent, wear-resistant material located between the end face of the cylinder (7) and a matching end face of the bearer ring.

5. Construction according to claim 1, wherein the end face of the cylinder (7) and the bearer ring (1) are formed with at least three matching bores (23, 25), the bores in the cylinder and in the bearer ring being in alignment;

an eccenter pin (21) inserted in the bores of the bearer ring and of the end face of the cylinder, the eccenter pins (21) having a first portion (27) fitting into the bore (23) of the bearer ring and a second portion (29) fitting into the bore (25) of the cylinder, said first and second portions being eccentrically positioned with respect to each other;

further bores (35) formed in the bearer ring and positioned adjacent the bores therethrough having the matching bores in the cylinder;

a guide pin (33) introduced into each one of said further bores;

and a connecting link (37) connecting the eccentric pin (21) and the guide pin, the guide pin being secured in said further bore by the further pin (35) and rotatably accepting the eccenter pin to determine the position of rotation of the eccenter pin;

and means (39, 41, 43) arresting the eccenter pin in a predetermined rotational position.

6. Construction according to claim 5, wherein the bearer ring (1) comprises a two-part element, separated by diametrical gap (51);

means (57) attaching said parts together to form a closed ring;

said first bores and eccenter pins (21) being positioned in one of the part-elements in the vicinity of said gap;

and an additional bore (55) passing through said link (37), said bearer ring and into the end face of the cylinder and positioned in the vicinity of the gap in the other part of the bearer ring to provide for adjustable connection by means of the link (37) and an additional eccenter pin (53) of said part-elements together.

7. Construction according to claim 5, wherein the portion (29) of the pin (21) extending into the bore (25) in the end face of the cylinder (7) has an at least part-spherical outer surface.

8. Construction according to claim 5, wherein the bores (25) extending into the end face of the cylinder (7) are formed as elongated openings having an arcuate extent, concentric with the axis of rotation of the cylinder, the arcuate openings (45) permitting circumferential adjustment of the position of the bearer ring with respect to the associated printing cylinder.

9. Construction according to claim 7, further comprising a hub element (9) secured to the shaft (5) of the press cylinder (7), the hub element having a part-spherical outer surface and forming the shaft engagement surface (9), the hub element (3) having a cylindrical bore fitting on the shaft (5) of the cylinder (7).

10. Construction according to claim 9, further comprising an intermediate layer (13) made of an elastic, shock-absorbent, wear-resistant material located between the engagement surfaces (9, 11) of the bearer ring (1) and of the shaft, respectively;

and further including a washer or disk-shaped element (15) of elastic, shock-absorbent, wear-resistant material located between the end face of the cylinder (7) and a matching end face of the bearer ring.

* * * * *